US009265330B1

(12) United States Patent
Golin

(10) Patent No.: US 9,265,330 B1
(45) Date of Patent: Feb. 23, 2016

(54) CONVERTIBLE SEAT COVER

(71) Applicant: Melissa Golin, Palmetto Bay, FL (US)

(72) Inventor: Melissa Golin, Palmetto Bay, FL (US)

( * ) Notice: Subject to any disclaimer, the term of this patent is extended or adjusted under 35 U.S.C. 154(b) by 2 days.

(21) Appl. No.: 14/469,252

(22) Filed: Aug. 26, 2014

Related U.S. Application Data

(63) Continuation-in-part of application No. 13/758,319, filed on Feb. 4, 2013, now Pat. No. 8,919,879.

(51) Int. Cl.
*A45F 4/02* (2006.01)
*A47C 31/11* (2006.01)

(52) U.S. Cl.
CPC . *A45F 4/02* (2013.01); *A47C 31/11* (2013.01); *A45F 2004/026* (2013.01)

(58) Field of Classification Search
CPC ..... A47F 7/66; A45F 4/02; A45F 3/04; A45F 3/047; B65D 33/28
USPC ..... 297/219.1, 223, 224, 228.1
See application file for complete search history.

(56) References Cited

U.S. PATENT DOCUMENTS

| | | | | |
|---|---|---|---|---|
| D584,894 | S | 1/2009 | McDaniel | |
| 8,342,750 | B2 * | 1/2013 | Heinlen | B65D 31/04 383/2 |
| 8,491,976 | B2 | 7/2013 | Sato et al. | |
| 2004/0179756 | A1 | 9/2004 | Kani | |
| 2009/0026159 | A1 | 1/2009 | Mazur et al. | |
| 2010/0284631 | A1 | 11/2010 | Lee | |

* cited by examiner

*Primary Examiner* — Sarah McPartlin
(74) *Attorney, Agent, or Firm* — Albert Bordas, P.A.

(57) ABSTRACT

A stadium-styled universal seat cover that converts to a backpack or tote. More specifically, a convertible seat cover having a front wall with first and second lateral edges, and first and second edges. The front wall also has first stitching adjacent to the first edge. The front wall further has a first channel. A rear wall extends from the second edge. The rear wall has third and fourth lateral edges, and a third edge. The rear wall further has second stitching adjacent to the third edge. An engaging wall extends from the third edge. The engaging wall has first and second lateral walls, and a fourth edge. The engaging wall further has third stitching adjacent to the fourth edge; and a cord assembly.

16 Claims, 5 Drawing Sheets

CONVERTIBLE SEAT COVER

OTHER RELATED APPLICATIONS

The present application is a continuation-in-part of pending U.S. patent application Ser. No. 13/758,319, filed on Feb. 4, 2013, which is hereby incorporated by reference.

BACKGROUND OF THE INVENTION

1. Field of the Invention

The present invention relates to seat covers, and more particularly, to seat covers that convert to backpacks or totes.

2. Description of the Related Art

Applicant believes that one of the closest references corresponds to U.S. Patent Application Publication No. 2004/0179756 A1, published on Sep. 16, 2004 to Hisato Kani for Storage Bag. However, it differs from the present invention because Kani discloses a storage bag that includes a string for closing an openable and closeable opening portion. The storage bag is fun in that contours and expressions of animals or human figures drawn on a bag body change. Ear portions 3, which resemble those of a human figure or an animal, project from both sides of an opening edge of the bag body 2, and a string 1 is disposed in the bag body 2 except for the ear portions 3. The storage bag is configured so that the ear portions 3 rise up when the string 1 is pulled and the opening is closed Applicant believes that another reference corresponds to U.S. Pat. No. D584,894 S issued to Javaughn McDaniel on Jan. 20, 2009 for Carrying Bag. However, it differs from the present invention because McDaniel teaches an ornamental design for a carrying bag.

Applicant believes that another reference corresponds to U.S. Patent Application Publication No. 2010/0284631 A1, published on Nov. 11, 2010 to Alexander S. Lee for Bag, Tote, and Backpack with Channel-Anchored Drawstrings. However, it differs from the present invention because Lee teaches a drawstring bag comprising (i) a flexible container, which has at least one wall, a closed bottom, an open top, and a channel comprising at least two openings, (ii) a first drawstring, the ends of which are anchored at or near the first opening, (iii) a second drawstring, the ends of which are anchored at or near the second opening, and (iv) optionally, grips adjacent to the first and second openings; a tote comprising the drawstring bag and at least one handle and/or a strap comprising elongated grips connected by an opener; a backpack comprising the drawstring bag, first and second points of attachment at or near the edge of the at least one wall at the closed bottom end of the container through which the drawstrings pass, and, optionally, at least one handle and/or a strap comprising elongated grips connected by an opener, and/or drawstring length adjusters; and a method of stabilizing a drawstring in a flexible container.

Applicant believes that another reference corresponds to U.S. Patent Application Publication No. 2009/0026159 A1, published on Jan. 29, 2009 to Mazur et al. for Systems and Methods for Organizing, Storing, and Carrying Items. However, it differs from the present invention because Mazur teaches an organization system may include a storage device comprising a plurality of compartments, wherein the plurality of compartments comprise at least a first compartment having a first characteristic feature and at least a second compartment having a second characteristic feature that differs from the first characteristic feature. The organization system may also include a first portable container comprising the first characteristic feature and a second portable container comprising the second characteristic feature.

Applicant believes that another reference corresponds to U.S. Pat. No. 8,491,976 B2 issued to Sato et al. on Jul. 23, 2013 for Laminate, Package, Packaging Sheet, Packaging Material, Labe and Container. However, it differs from the present invention because Sato teaches a laminate and the like capable of improving the barcode reading accuracy with a configuration having a smaller number of layers is provided. Further, a laminate and the like capable of further improving the barcode reading accuracy and further reducing the size of a barcode portion even when applied to a conventional layer configuration is provided. The laminate includes a colored barcode print layer 5, a base material layer 1, and a bead-containing coating layer 7 having beads 7*b* dispersed in a resin 7*a*.

Other patents describing the closest subject matter provide for a number of more or less complicated features that fail to solve the problem in an efficient and economical way. None of these patents suggest the novel features of the present invention.

SUMMARY OF THE INVENTION

The instant invention is a stadium-styled universal seat cover that converts to a backpack or tote. More specifically, the instant invention is a convertible seat cover comprising a front wall comprising first and second lateral edges, and first and second edges. The front wall also comprises first stitching adjacent to the first edge. The front wall further comprises a first channel. A rear wall extends from the second edge. The rear wall comprises third and fourth lateral edges, and a third edge. The rear wall further comprises second stitching adjacent to the third edge. An engaging wall extends from the third edge. The engaging wall comprises first and second lateral walls, and a fourth edge. The engaging wall further comprises third stitching adjacent to the fourth edge; and a cord assembly.

The engaging wall comprises an expandable section. The front and rear walls comprise a window that is transparent. Further comprising a matrix barcode. The first channel extends between the first edge and the first stitching. The front wall and the rear wall have a similar shape and dimension. The engaging wall extends from the third edge a predetermined distance towards the second edge. The rear wall further comprises a second channel. The second channel extends between the third edge and the second stitching.

Further comprising first and second retaining sleeves located at a predetermined distance from the second edge. The cord assembly comprises two cords. The two cords each have first and second ends. The first ends are secured to the first retaining sleeve. The second ends enter through the first and second channels. The second ends exit through the first and second channels. The second ends are secured at the second retaining sleeve. The cord assembly is secured between the first edge and the first stitching at the front wall, and between the third edge and the second stitching at the rear wall.

It is therefore one of the main objects of the present invention to provide a stadium-styled universal seat cover that converts to a backpack or tote having advertising thereon.

It is another object of the present invention to provide a stadium-styled universal seat cover that converts to a backpack or tote that fits seats with or without armrests.

It is another object of the present invention to provide a stadium-styled universal seat cover that converts to a backpack or tote that is volumetrically efficient for carrying, transporting, and storage.

It is another object of the present invention to provide a stadium-styled universal seat cover that converts to a backpack or tote without the need of any special tools.

It is another object of the present invention to provide a stadium-styled universal seat cover that converts to a backpack or tote that is of a durable and reliable construction.

It is yet another object of this invention to provide such a seat cover that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
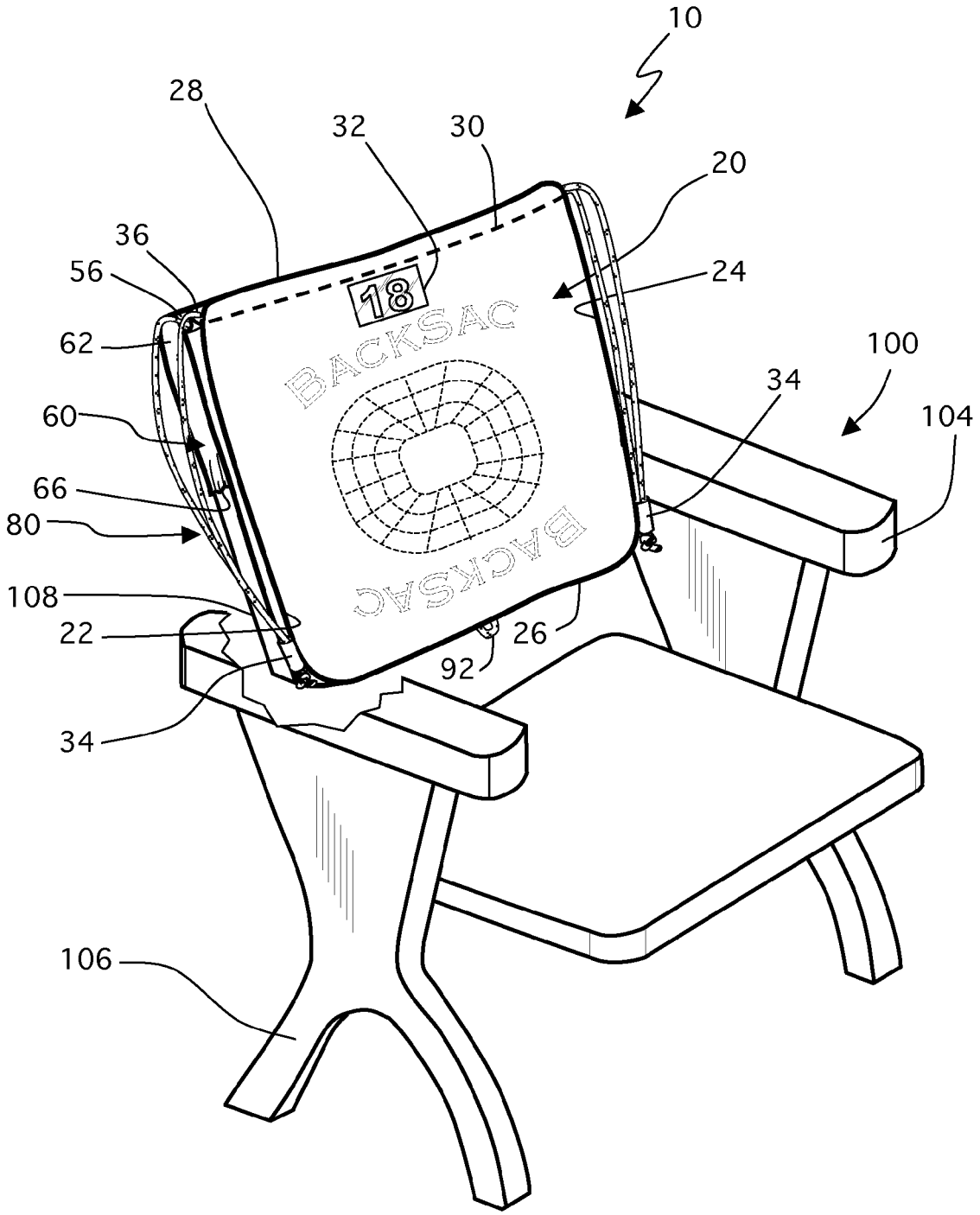
FIG. 1 is a front isometric view of a convertible seat cover in a seat cover configuration mounted upon a seat.

Referring now to the drawings, the present invention is a stadium-styled universal seat cover that converts to a backpack or tote, and is generally referred to with numeral 10. It can be observed that it basically includes front wall 20, rear wall 40, and engaging wall 60.

As seen in FIG. 1, front wall 20 comprises lateral edges 22 and 24, and edges 26 and 28. Front wall 20 also comprises stitching 30 adjacent to edge 28. Retaining sleeves 34 are located at a predetermined distance from edge 26, preferably adjacent to lateral edges 22 and 24. In an alternate embodiment, grommets may be used instead of retaining sleeves 34. In addition, front wall 20 comprises channel 36.

Figure 2:
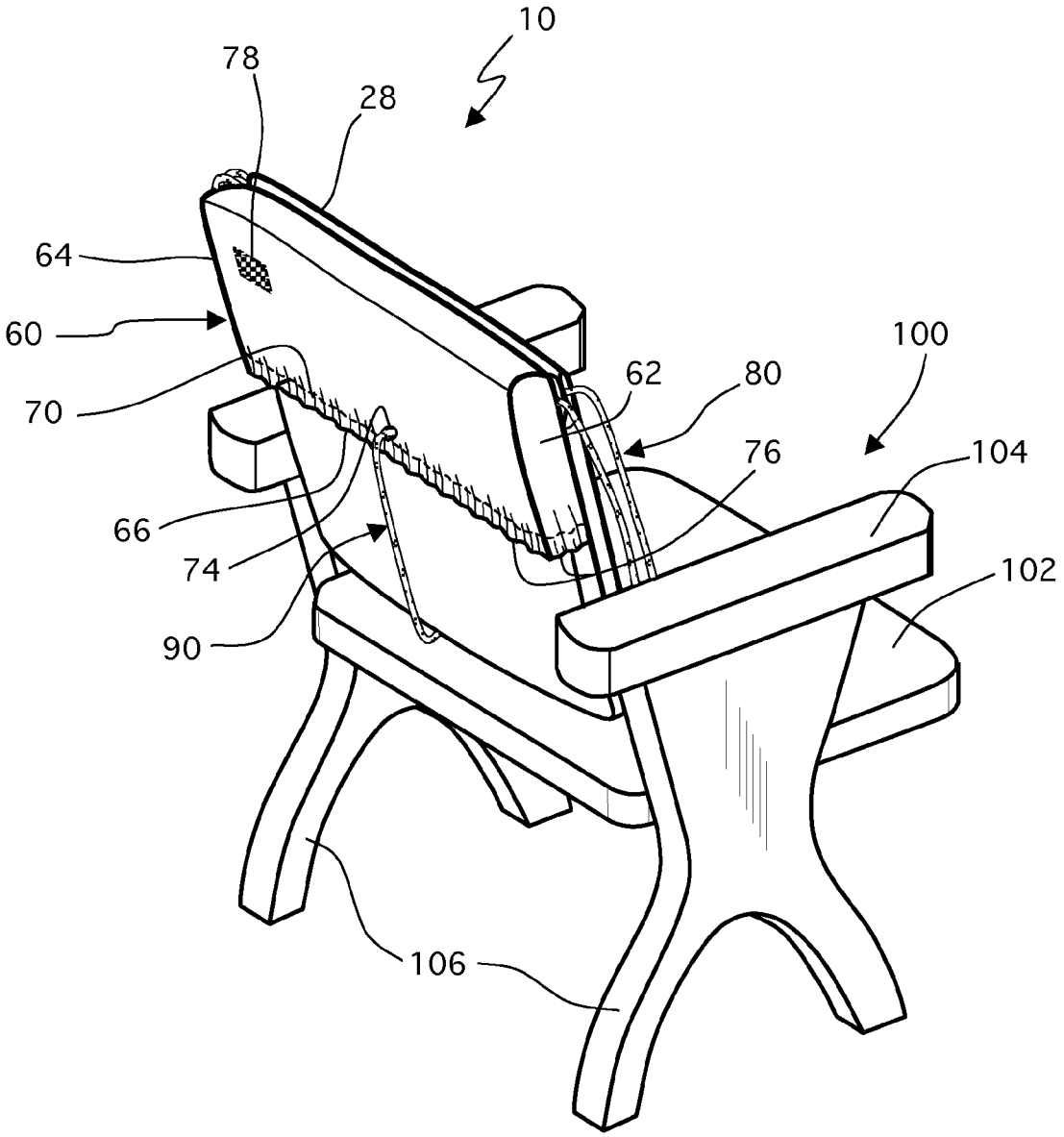
FIG. 2 is a rear isometric view of the convertible seat cover in the seat cover configuration mounted upon the seat seen in FIG. 1.

As seen in FIGS. 1 and 2, seat assembly 100 comprises seat 102, armrests 104, legs 106, and backrest 108. In some cases, backrest 108 may have a seat number or identification data thereon. In the illustrated example, backrest 108 has seat number "18". Front wall 20 and rear wall 40 comprise window 32, which is transparent, so that the seat number is visible.

Figure 3:
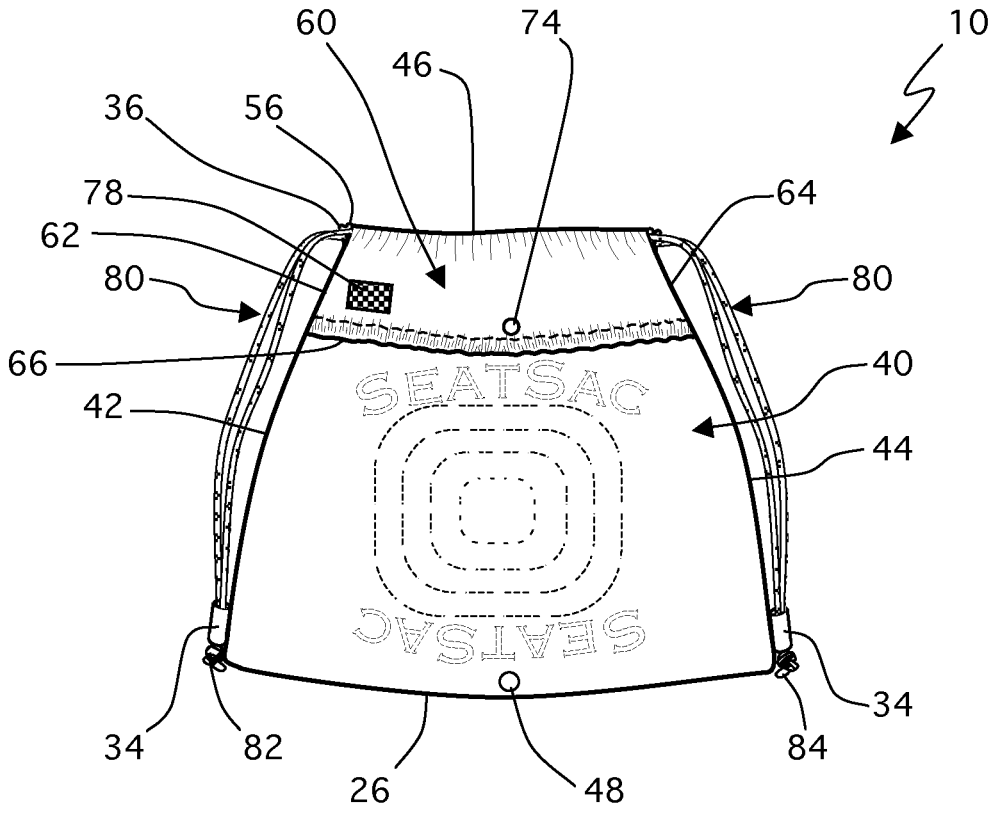
FIG. 3 is a front elevational view of the convertible seat cover in a backpack configuration.

As seen in FIG. 2, engaging wall 60 extends from edge 28 a predetermined distance towards edge 26 seen in FIG. 3. Engaging wall 60 comprises lateral walls 62 and 64, and edge 66. Engaging wall 60 also comprises stitching 70 adjacent to edge 66. Attachment point 74 is located at a predetermined distance from edge 66. In addition, engaging wall 60 comprises expandable section 76. Cord 90 may extend from attachment point 74 and may be secured to grommet 48, seen in FIG. 3, with end 92 as seen in FIG. 1, in an effort to keep instant invention 10 better mounted onto chair assembly 100, and specifically backrest 108. Instant invention 10 may further comprise matrix barcode 78.

As seen in FIG. 3, present invention 10 is a stadium-styled universal seat cover that converts to a backpack or tote, whereby front wall 20 and rear wall 40 have a similar shape and dimension in a preferred embodiment. Rear wall 40 extends from edge 26 and comprises lateral edges 42 and 44, and edge 46. In addition, rear wall 40 comprises channel 56.

In a preferred embodiment, cord assembly 80 comprises two cords, each having ends 82 and 84. In a preferred embodiment, ends 82 are secured at a first retaining sleeve 34. The cords enter through channels 36 and 56 respectively, and exit, and ends 84 are secured at the second retaining sleeve 34. It is noted that cord assembly 80 is secured between edge 28 and stitching 30 at front wall 20 as seen in FIG. 1, and between edge 46 and stitching 50 at rear wall 40, as seen in FIG. 5.

Figure 4:
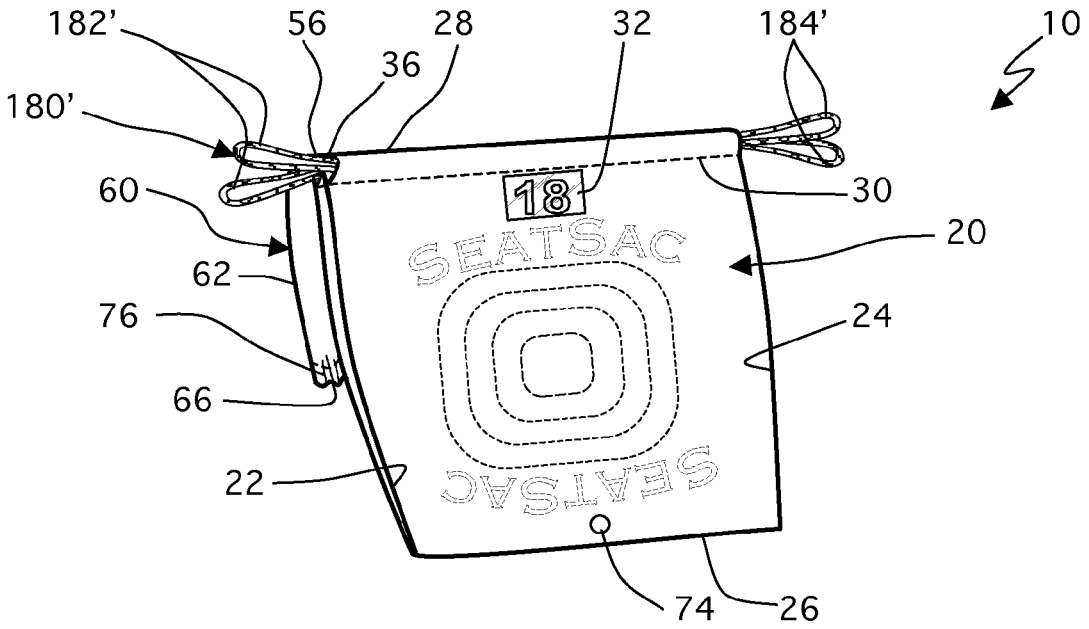
FIG. 4 is a front isometric view of an alternate embodiment of the convertible seat cover in a seat cover configuration.
Figure 5:
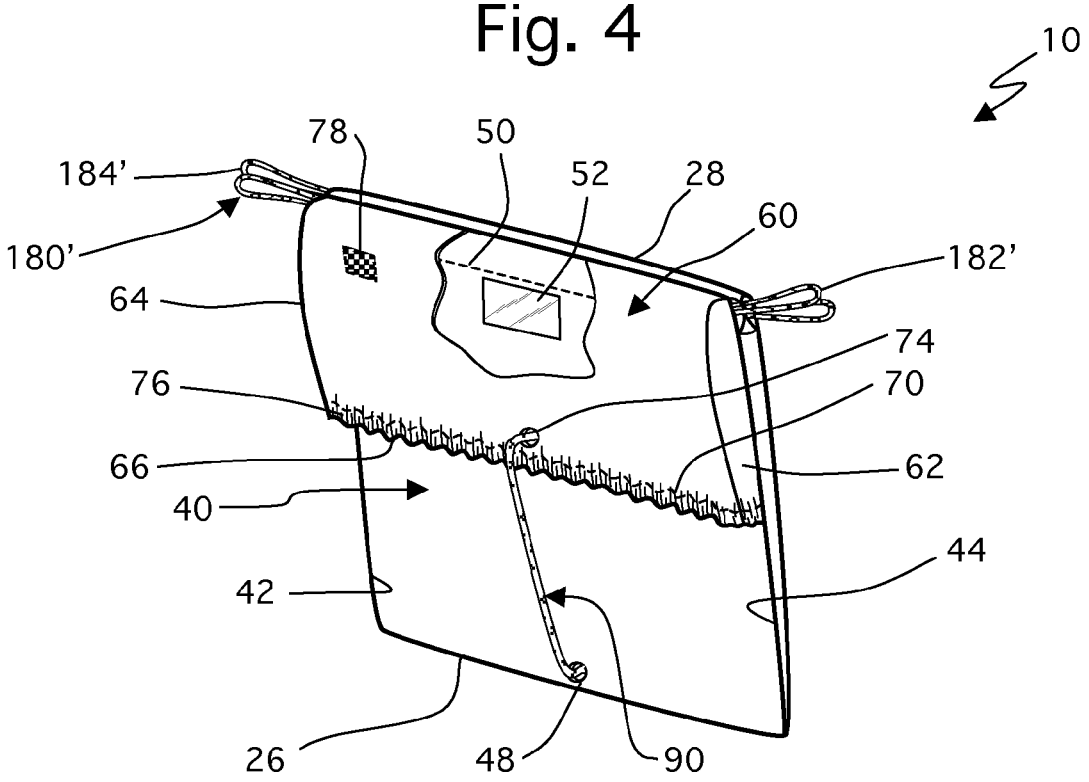
FIG. 5 is a rear isometric view of the alternate embodiment of the convertible seat cover in a seat cover configuration seen in FIG. 4.
Figure 6:
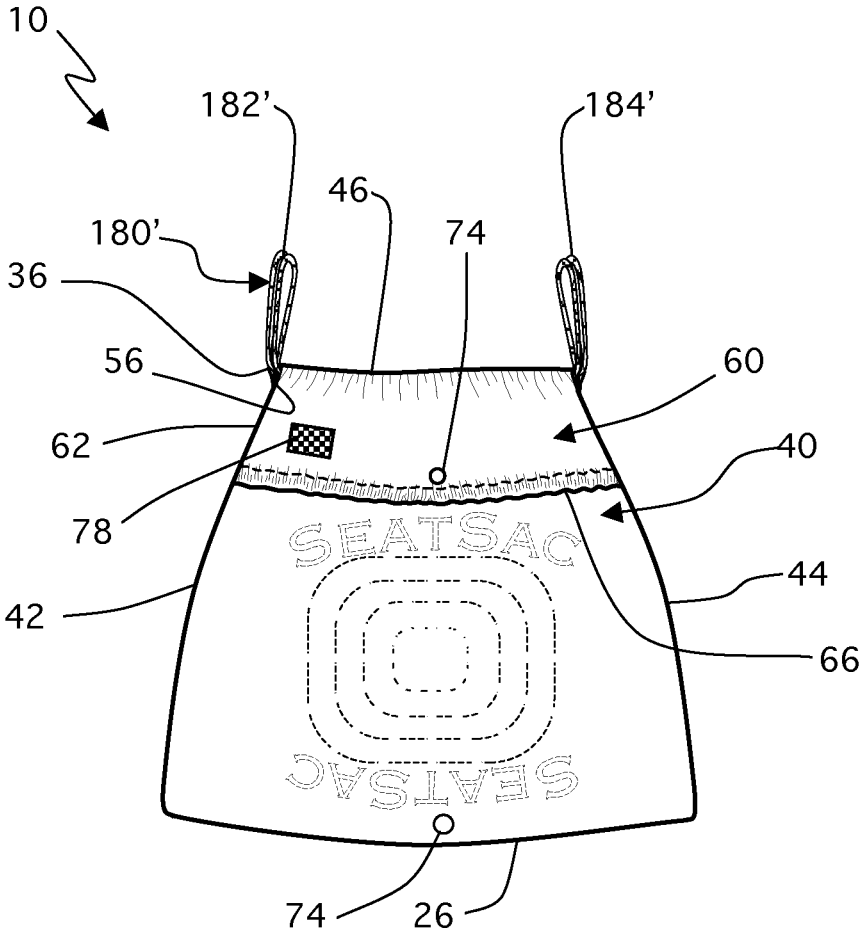
FIG. 6 is a front elevational view of the alternate embodiment of the convertible seat cover in a tote configuration.

Seen in FIGS. 4, 5, and 6 is an alternate embodiment of instant invention 10.

As seen in FIG. 4, front wall 20 comprises lateral edges 22 and 24, and edges 26 and 28. Front wall 20 also comprises stitching 30 adjacent to edge 28. In addition, front wall 20 comprises channel 36. Front wall 20 comprises window 32, which is transparent, so that a seat number is visible.

As seen in FIG. 5, engaging wall 60 extends from edge 26 a predetermined distance towards edge 46. Engaging wall 60 comprises lateral walls 62 and 64, and edge 66. Engaging wall 60 also comprises stitching 70 adjacent to edge 66. Attachment point 74 is located at a predetermined distance from edge 66. In addition, engaging wall 60 comprises expandable section 76. Cord 90 may extend from attachment point 74 and may be secured to grommet 48 in an effort to keep instant invention 10 better mounted onto chair assembly 100, and specifically backrest 108 seen in FIGS. 1 and 2. Instant invention 10 may further comprise matrix barcode 78. It is noted that rear wall 40 comprises window 52, like front wall 20, which is transparent, so that the seat number is visible. Also, rear wall 40 also comprises stitching 50 adjacent to edge 46.

As seen in FIG. 6, present invention 10 is a stadium-styled universal seat cover that converts to a backpack or tote, whereby front wall 20 and rear wall 40 have a similar shape and dimension in a preferred embodiment. Rear wall 40 extends from edge 26 and comprises lateral edges 42 and 44, and edge 46. In addition, rear wall 40 comprises channel 56.

In a preferred embodiment, cord 180' comprises two cords, each having ends 182' and 184' that extend from channel 36, seen in FIG. 4, and 56 respectively. It is noted that cord 180' is secured between edge 28 and stitching 30 at front wall 20 as seen in FIG. 4, and between edge 46 and stitching 50 at rear wall 40.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A convertible seat cover comprising:

A) a front wall comprising first and second lateral edges, and first and second edges, said front wall also comprises first stitching adjacent to said first edge, said front wall further comprises a first channel;

B) a rear wall that extends from said second edge, said rear wall comprises third and fourth lateral edges, and a third edge, said rear wall further comprises second stitching adjacent to said third edge;

C) an engaging wall that extends from said third edge, said engaging wall comprises first and second lateral walls, and a fourth edge, said engaging wall further comprises third stitching adjacent to said fourth edge; and D) a cord assembly.

2. The convertible seat cover set forth in claim 1, further characterized in that said engaging wall comprises an expandable section.

3. The convertible seat cover set forth in claim 1, further characterized in that said front and rear walls comprise a window that is transparent.

4. The convertible seat cover set forth in claim 1, further comprising a matrix barcode.

5. The convertible seat cover set forth in claim 1, further characterized in that said first channel extends between said first edge and said first stitching.

6. The convertible seat cover set forth in claim 1, further characterized in that said front wall and said rear wall have a similar shape and dimension.

7. The convertible seat cover set forth in claim 1, further characterized in that said engaging wall extends from said third edge a predetermined distance towards said second edge.

8. The convertible seat cover set forth in claim 1, further characterized in that said rear wall further comprises a second channel.

9. The convertible seat cover set forth in claim 8, further characterized in that said second channel extends between said third edge and said second stitching.

10. The convertible seat cover set forth in claim 9, further comprising first and second retaining sleeves located at a predetermined distance from said second edge.

11. The convertible seat cover set forth in claim 10, further characterized in that said cord assembly comprises two cords.

12. The convertible seat cover set forth in claim 11, further characterized in that said two cords each have first and second ends.

13. The convertible seat cover set forth in claim 12, further characterized in that said first ends are secured to said first retaining sleeve.

14. The convertible seat cover set forth in claim 13, further characterized in that one of said two cords extends through said first channel and the other of said two cords extends through said second channel.

15. The convertible seat cover set forth in claim 14, further characterized in that said second ends are secured at said second retaining sleeve.

16. The convertible seat cover set forth in claim 15, further characterized in that said cord assembly is secured between said first edge and said first stitching at said front wall, and between said third edge and said second stitching at said rear wall.

* * * * *